US005361601A

United States Patent [19]

Han et al.

[11] Patent Number: 5,361,601

[45] Date of Patent: Nov. 8, 1994

[54] AIR CONDITIONER

[75] Inventors: Geun P. Han; Ho Y. Sung, all of Suwon-City, Rep. of Korea

[73] Assignee: Samsung Electronics Co., Ltd., Suwon, Rep. of Korea

[21] Appl. No.: 91,360

[22] Filed: Jul. 15, 1993

[30] Foreign Application Priority Data

Jul. 16, 1992 [KR] Rep. of Korea ..... 92-12740

[51] Int. Cl.[5] ..... F25B 13/00; F25B 29/00

[52] U.S. Cl. ..... 62/324.6; 62/160; 165/29; 165/62; 237/2 B

[58] Field of Search ..... 62/324.1, 324.6, 160, 62/159; 165/29, 62; 237/2 B

[56] References Cited

U.S. PATENT DOCUMENTS

| | | | |
|---|---|---|---|
| 2,134,188 | 10/1938 | Haywood | 165/62 |
| 2,893,218 | 7/1959 | Harnish | 62/324.1 |
| 3,777,508 | 12/1973 | Imabayashi et al. | 62/324.1 |
| 4,506,521 | 3/1985 | Asano et al. | 62/238.7 |
| 4,569,207 | 2/1986 | James | 62/235.1 |
| 4,918,933 | 4/1990 | Dyer | 62/79 |
| 5,174,365 | 12/1992 | Noguchi et al. | 165/29 |

FOREIGN PATENT DOCUMENTS

| | | | |
|---|---|---|---|
| 62-62278 | 12/1987 | Japan . | |
| 2013761 | 1/1990 | Japan | 165/62 |

*Primary Examiner*—Henry A. Bennet
*Assistant Examiner*—William C. Doerrler
*Attorney, Agent, or Firm*—Burns, Doane, Swecker & Mathis

[57] ABSTRACT

An air conditioner is selectively operable in a main heating mode, a cooling mode and an auxiliary heating mode. In the main heating and cooling modes, refrigerant is circulated through a main line which includes a compressor, an outdoor heat exchanger, an expansion valve, and an indoor heat exchanger. In the auxiliary heating mode, the compressor is not activated, and the refrigerant is circulated through an auxiliary line having opposite ends connected by valves to the main line at opposite sides of the indoor heat exchanger. A pump and heater are disposed in the auxiliary line so that in the auxiliary heating mode, refrigerant is circulated by the pump through the heater and the indoor heat exchanger and back to the pump.

4 Claims, 3 Drawing Sheets

AIR CONDITIONER

BACKGROUND OF THE INVENTION

The invention relates to an air conditioning system which increases the efficiency of the heating cycle when it operates in a location where the temperature remains above zero (0° C.) and region where the daily temperature variation is severe.

Conventional air conditioning systems are illustrated in FIGS. 1 and 2, which illustrate a heat pump and a refrigerant heating type air conditioner, respectively. The cooling operation of these air conditioners is performed when a high temperature, high pressure refrigerant gas discharged from a compressor 1 flows into an outdoor heat-exchanger 2 in the direction of the solid line arrows. The refrigerant gas is condensed at the outdoor heat-exchanger, i.e. the condenser, and changed into a high pressure liquid phase refrigerant, and then it flows into an expansion tube 3.

The high pressure liquid refrigerant is transformed into a low temperature, low pressure liquid refrigerant by the effect caused by the expansion tube 3, and then it flows into an indoor heat-exchanger 4, i.e. the evaporator. At the evaporator, the liquid refrigerant is changed into a low temperature, low pressure gaseous refrigerant and finally it flows back to the compressor 1. By repeating the above cycle, the cooling operation is performed.

In the heating mode, shown in FIG. 1, performed by a heat pump type air conditioner, a high temperature, high pressure gaseous refrigerant is discharged from a compressor 1 and flows into an indoor heat-exchanger 4 in the direction of the broken line arrows. The gas is condensed at the indoor heat-exchanger 4 and then heat is dispersed by air introduced from the indoor location by cross fan 5. The air then flows to the desired indoor location to perform the heating function. Further, a high pressure liquid refrigerant then flows into an expansion tube 3.

The high pressure liquid refrigerant is transformed into a low temperature, low pressure liquid refrigerant by the effect caused by the expansion tube 3, and then it flows into an outdoor heat-exchanger 2, i.e. the evaporator. At the evaporator, the liquid refrigerant is changed into a low temperature, low pressure gaseous refrigerant and finally it flows back to the compressor 1.

However, because the compressor employed in of the above described air conditioner may have a larger capacity than is needed during the heating cycle, there is a problem in that excessive power consumption is required. Furthermore, because the outdoor environmental temperature is low, the liquid refrigerant insufficiently heat-exchanges at the indoor heat exchanger. The refrigerant directed to a compressor consists of a large amount of liquid, and thus the heating efficiency is decreased. For example, when the outdoor temperature is under 50° C. the full effect of the heating operation is seldom attained.

To perform the heat-exchange operation regardless of the above described drop in the outdoor temperature, a refrigerant heating type air conditioner using prior art is shown in FIG. 2.

In an auxiliary heating mode, performed according to the air conditioner of FIG. 2, a high temperature refrigerant heated by a heater 7 flows into a compressor 1 and then into an indoor heat-exchanger 4 in the direction of the broken line arrows. The indoor heat-exchanger, i.e. the condenser, receives the refrigerant to be condensed. At the condenser the indoor air drawn by a cross fan 5 is heat-exchanged. The heat exchanged air is blown to the indoor space to achieve the desired heating effect. Further, a liquid refrigerant under high temperature flows back to the heater 7. Numeral 18 is the refrigerant tube. The typical refrigerant heating type air conditioner is disclosed in Japanese Patent Publication No.1987-62278.

However, even in a location where the temperature is above zero and the daily temperature variations are severe, a compressor located on the main refrigerant tube may be employed to perform the main heating function in this type of air conditioner. When the air conditioner is employed for the auxiliary heating function in the above described location, the compressor may have an excessive capacity, thereby decreasing the efficiency of the system.

SUMMARY OF THE INVENTION

The object of the present invention is to provide an air conditioner utilizing a second closed cycle which includes an individual pump and a refrigerant heating means and performs a high efficiency heating operation in locations where the temperature remains above zero (0° C.) and the daily temperature variations are severe.

Another object of the present invention is to provide an air conditioner utilizing a second closed cycle which is installed at an indoor location and operates regardless of a drop in the outdoor temperature.

According to the present invention, an air conditioner is provided with a compressor, an indoor heat exchanger, an expansion tube and an outdoor heat exchanger connected to the main refrigerant tube. Further, the air conditioner comprises an initial three way valve located on the main refrigerant tube connected between the expansion tube and the indoor heat exchanger. The air conditioner further comprises a second three way valve located on the main refrigerant tube connected between the indoor heat-exchanger and the compressor.

Furthermore, the air conditioner comprises an auxiliary refrigerant tube which is connected to both the initial three way valve and the second three way valve. Also, the pump and refrigerant heater are sequentially located behind the second three way valve on the auxiliary refrigerant tube.

During the cooling cycle, the initial three way valve is set such that the refrigerant from the expansion tube flows into the indoor heat-exchanger, while the second three way valve is set such that the refrigerant from the indoor heat-exchanger enters the compressor. The refrigerant discharged from the compressor flows into the indoor heat-exchanger, and then flows back to the expansion tube.

During the heating cycle, the second three way valve is set such that the refrigerant from the indoor heat-exchanger flows into the pump mounted on the auxiliary refrigerant tube, and then the refrigerant from the pump flows into the heater. The initial three way valve is set such that the heated refrigerant enters the indoor heat-exchanger. The heat-exchanging operation is performed to achieve a heating by the heated refrigerant.

BRIEF DESCRIPTION OF THE DRAWINGS

The invention will now be explained with reference to the accompanying drawings in which.

EXPLANATION OF THE PREFERRED EXAMPLES

Figure 1:
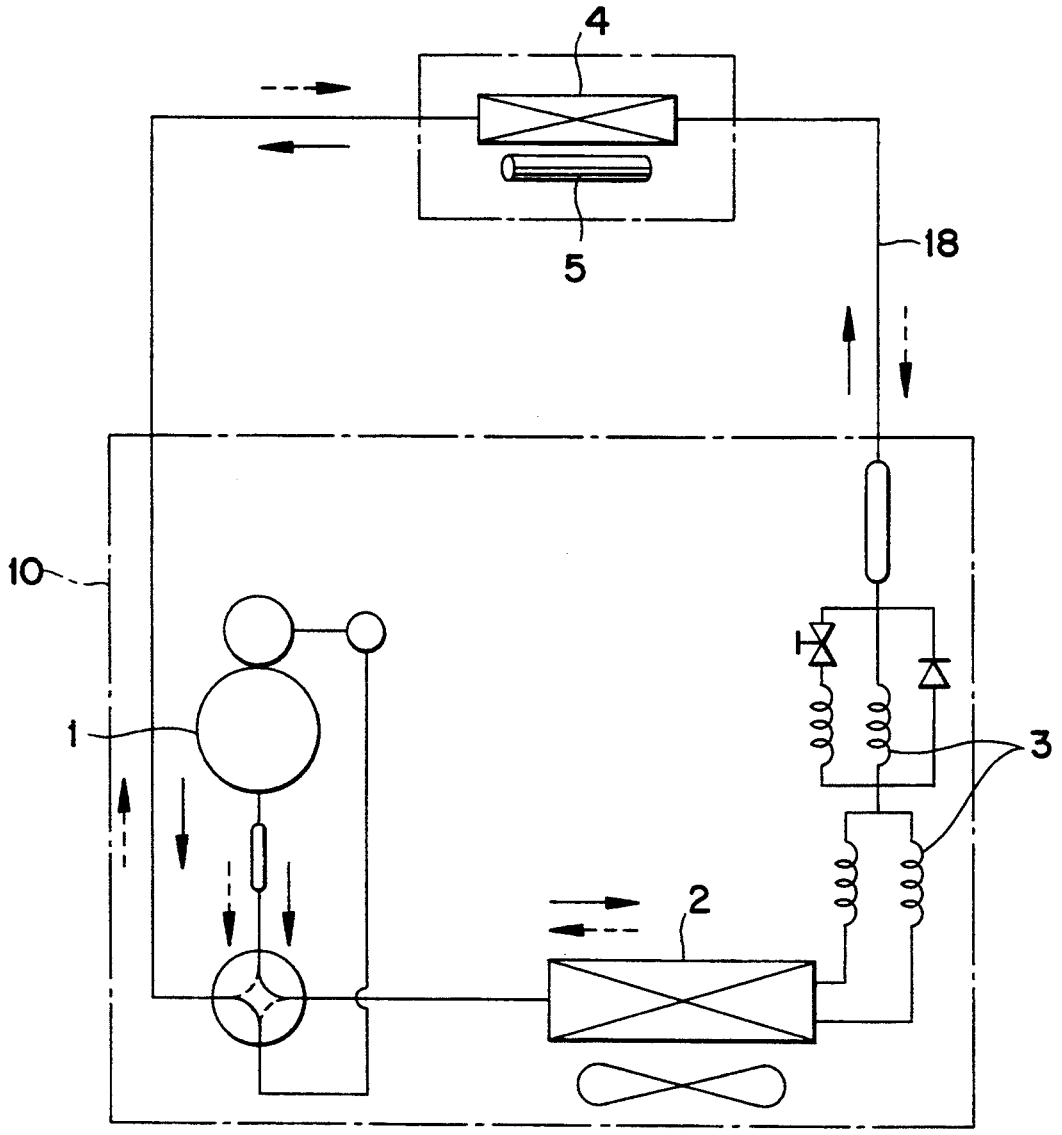
FIG. 1 (PRIOR ART)
FIG. 1 is a schematic diagram conceptionally illustrating a heat pump air conditioner according to prior art.
Figure 2:
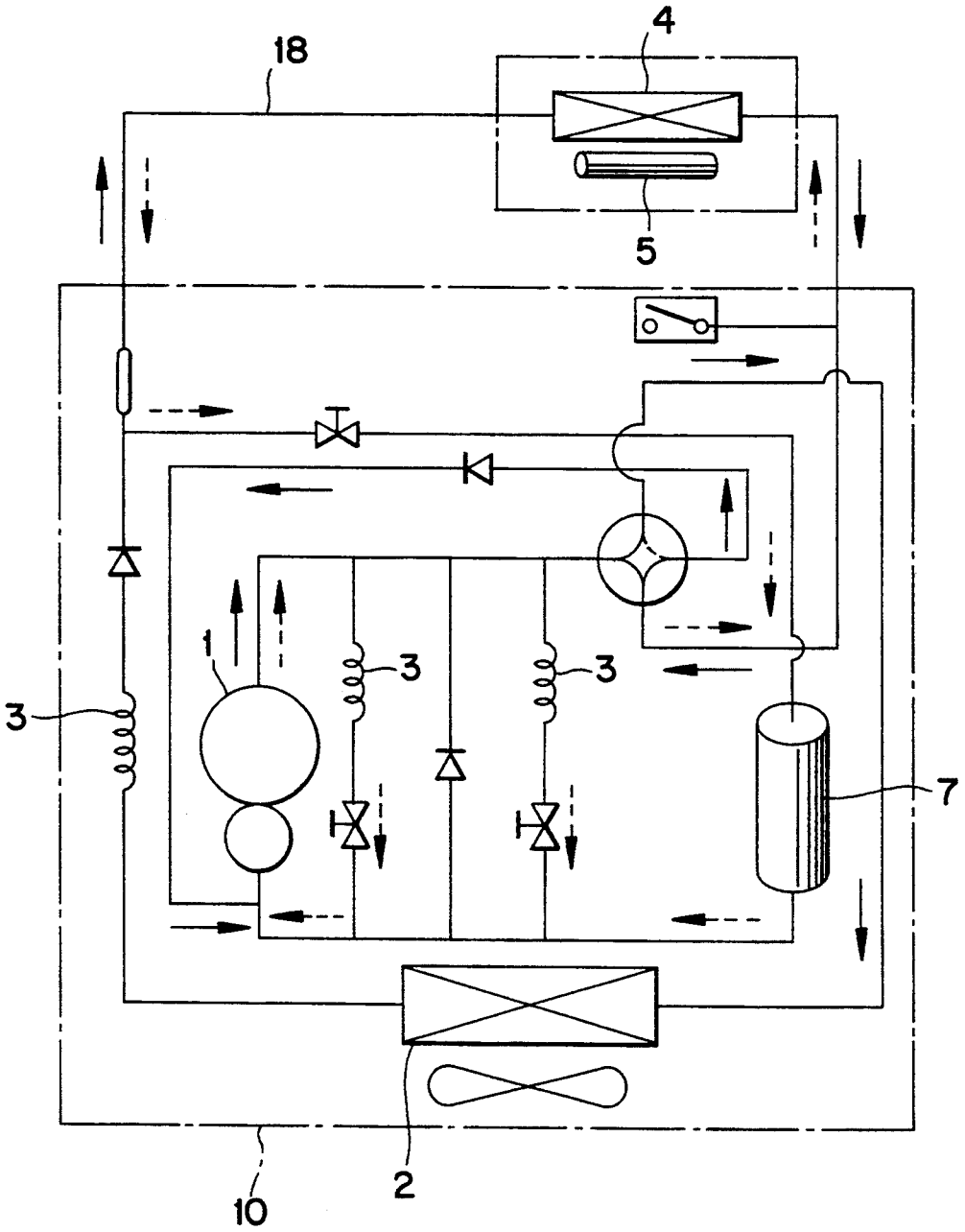
FIG. 2 (PRIOR ART)
FIG. 2 is a schematic diagram conceptionally illustrating a refrigerant heat air conditioner according to prior art.
Figure 3:
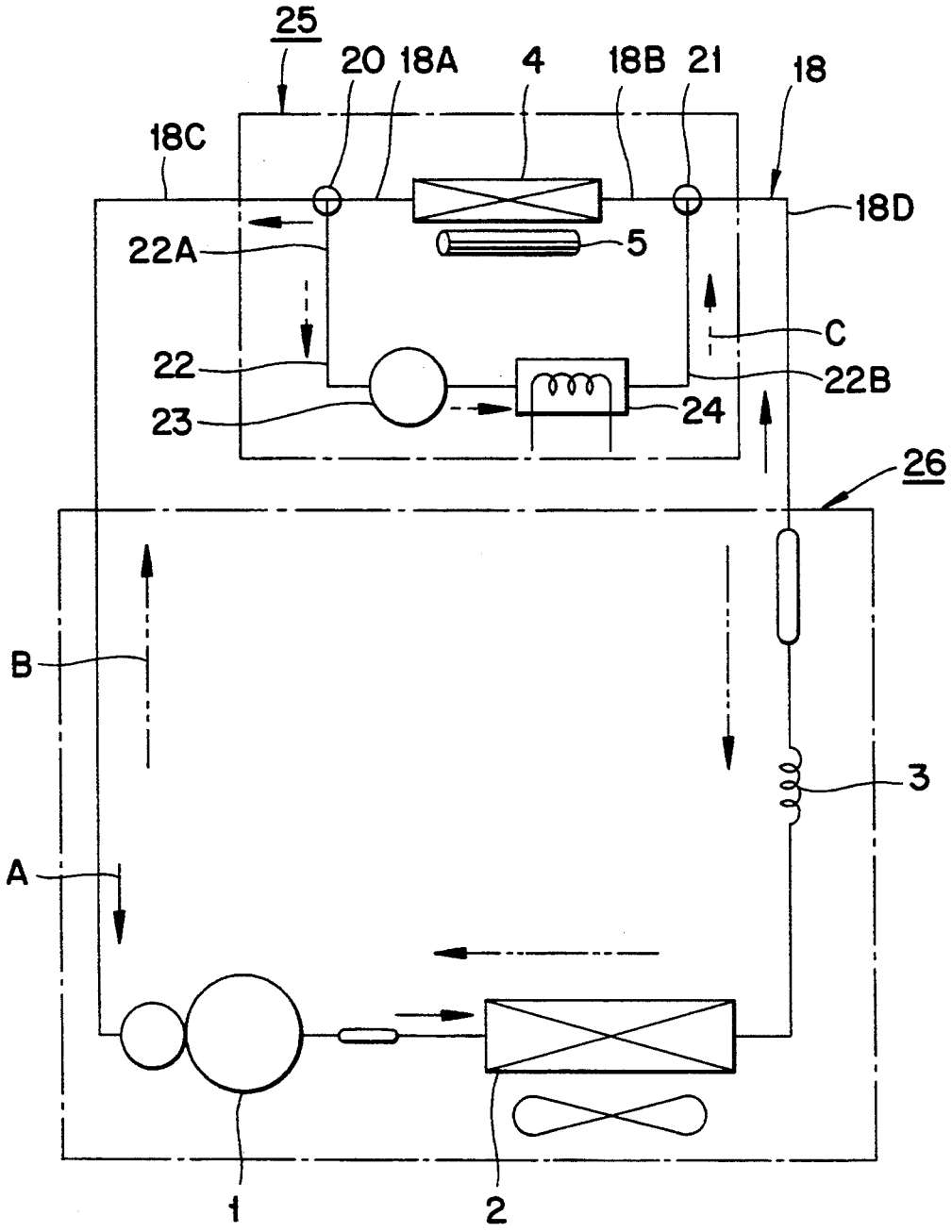
FIG. 3 is a schematic diagram conceptionally illustrating an air conditioner according to the invention.

FIG. 3 represents the schematic diagram of an air conditioner according to the invention. In FIG. 3, the same component parts as those in FIGS. 1 and 2 are designated by the same reference numerals as in FIGS. 1 and 2 and therefore they will not be explained further.

The air conditioner comprises an outdoor heat-exchanging portion 26 and an indoor heat-exchanging portion 25. The outdoor heat-exchanging portion 26 comprises a compressor 1, an outdoor heat-exchanger 2 and an expansion tube 3. The indoor heat-exchanging portion 25 comprises an indoor heat-exchanger 4 which is located on a main refrigerant tube 18 connecting sequentially the compressor 1, the expansion tube 3 and the indoor heat exchanger 4.

An initial three way valve 21 is attached to an inlet tube 18B of the indoor heat-exchanger 4, while a second three way valve 20 is attached to an outlet tube 18A of the indoor heat-exchanger 4. An auxiliary tube 22 branches from the main tube 18. At the junction point where tubes 22 and 18 intersect, the second three way valve 20 is located in order to control the flow direction, i.e. 18C or 22A, fed through the second three way valve 20.

Pump 23 is located on the auxiliary tube 22 adjacent to the second three way valve 20, while an electrical heating member 24 is located on the rear of the pump 23. A tube 22B extending from the heater 24 is connected to the main tube 18. At the junction point where tubes 22B and 18 intersect, the first three way valve 21 is located. The first three way valve controls the flow direction, i.e. 22B or 18D, fed into the initial three way valve 21. A tube 18B extends from the first three way valve 21 and connects to the indoor heat-exchanger 4.

During the cooling cycle, as when electrical power is supplied to the air conditioner, the auxiliary tube 22 connected to the initial three way valve 21 closes such that the tube 18D from the expansion tube 3 connects to the tube 18B into the indoor heat exchanger 4. Simultaneously, the auxiliary tube 22A connected to the second three way valve 20 closes such that the tube 18A from the indoor heat exchanger 4 connects to the tube 18C into the expansion tube 3.

During this cycle, a high temperature refrigerant gas under high pressure is discharged from the compressor 1. The gas enters the outdoor heat-exchanger 2 where it is condensed, and it is then transformed into a liquid refrigerant. The liquid refrigerant flows into the expansion tube 3 extending to the initial three way valve 21, in which the liquid under high pressure is transformed into a low pressure liquid refrigerant by the effect of the expansion tube 3. The liquid refrigerant goes into the indoor heat-exchanger 4 located in the indoor heat-exchanging portion 25. The liquid refrigerant is evaporated at the indoor heat-exchanger 4 and then it flows back into the compressor 1 via the second three way valve 20. The cycle is repeated in the direction of the solid line arrows A to perform the cooling operation.

During the heating cycle in a location where the outside temperature falls below a reference temperature, e.g. zero (0° C.), the connection between the first three way valve 21 and the second three way valve 20 is that as described above. That is, the tube 18D is connected with the tube 18B, while the tube 18A is connected with the tube 18C. The cycle is repeated in the direction of the alternate long and two short dash line arrows B to perform the main heating operation.

Additionally, during the heating cycle in a location where the outside temperature remains above zero (0° C.), the tube 18C of the second three way valve 20 closes such that the tube 18A connects to the tube 22A directing the pump 23 in an auxiliary heating mode. Simultaneously, the tube 18D of the initial three way valve 21 closes such that the tube 22B from the heater 24 connects to the tube 18B.

The refrigerant from the indoor heat exchanger 4 flows into the pump 23 via the second three way valve 20. The refrigerant passing the pump 23 goes into the heater 24 to be heated. A temperature sensor (not shown) is installed at an outgoing point of the refrigerant tube 22B for preventing the over-heating of the heater 24. The heated refrigerant flows into the indoor heat exchanger 4 through the initial three way valve 21. The above cycle is repeated in the direction of the broken line arrows C and the auxiliary heating operation is performed.

Thus, the illustrated embodiment of the present invention provides an air conditioner that performs a cooling operation utilizing the air condition cycle using the main refrigerant tube in a location where the temperature remains above zero (0° C.) and where the daily temperature variations are severe, while the cycle utilizing pump and heater located on the auxiliary tube is operated to obtain a auxiliary heating performance. Accordingly, since only the heater and the pump are employed without the compressor in the auxiliary heating mode, the air conditioner achieves a high efficiency of heating. Further, the auxiliary heating operation is performed without the heating efficiency being reduced by the outdoor temperature since the heating portion is mounted in the indoor heating portion.

What is claimed:

1. An air conditioner selectively operable in cooling and heating modes, comprising:

main heating and cooling means comprising a compressor, an indoor heat exchanger, an expansion tube, and an outdoor heat exchanger all interconnected by a main refrigerant line, so that in a cooling mode, refrigerant is circulated by said compressor through said outdoor heat exchanger, said expansion tube, and said indoor heat exchanger and back to said compressor, and in a main heating mode, operable only when the outside temperature is below a reference temperature, refrigerant is circulated by said compressor through said indoor heat exchanger, said expansion tube, and said outdoor heat exchange and back to said compressor; and auxiliary heating means operable only when the outside temperature is at or above said reference temperature for defining the sole heating mode, said auxiliary heating means comprising an auxiliary refrigerant line having inlet and outlet ends communicating with said main refrigerant line at junctions disposed at opposite sides, respectively, of said indoor heat exchanger;

pumping means and heating means disposed in said auxiliary line, and flow directing means selectively actuable in an auxiliary heating mode for directing all refrigerant exiting said indoor heat exchanger into said inlet end of said auxiliary line and for directing all refrigerant exiting said outlet end of said auxiliary line into said indoor heat exchanger, so that refrigerant is circulated by said pumping means through said heater and said indoor heat exchanger and back to said pumping means.

2. An air conditioner according to claim 1, wherein said heating means in said auxiliary line comprises an electric heater.

3. An air conditioner according to claim 1, wherein said pumping means and said heater are disposed indoors.

4. An air conditioner according to claim 1, wherein said flow directing means comprises a valve at each of said junctions.

* * * * *